United States Patent [19]

Masutani et al.

[11] 4,285,395

[45] Aug. 25, 1981

[54] STRUCTURE OF FLUID CONDENSING AND HEAT CONDUCTING SURFACE OF CONDENSER

[75] Inventors: Kenzo Masutani; Akira Horiguchi; Hiroyuki Sumitomo, all of Osaka, Japan

[73] Assignee: Hisaka Works, Limited, Osaka, Japan

[21] Appl. No.: 63,407

[22] Filed: Aug. 3, 1979

[30] Foreign Application Priority Data

Aug. 3, 1978 [JP] Japan ..... 53-95209

[51] Int. Cl.[3] ..... F28B 9/08

[52] U.S. Cl. ..... 165/110; 165/133; 165/167

[58] Field of Search ..... 165/110, 111, 133, 166–167; 62/285, 288, 289, 290

[56] References Cited

U.S. PATENT DOCUMENTS

| | | | |
|---|---|---|---|
| 2,099,665 | 11/1937 | Smith | 165/110 |
| 2,433,825 | 1/1948 | Brothers | 165/110 |
| 2,983,115 | 5/1961 | Caswell | 165/110 |
| 3,613,779 | 10/1971 | Brown | 165/110 |
| 3,762,468 | 10/1973 | Newson et al. | 165/110 X |
| 3,902,551 | 9/1975 | Lim et al. | 62/290 X |
| 4,166,498 | 9/1979 | Fujie et al. | 165/110 |
| 4,182,411 | 1/1980 | Sumitomo et al. | 165/110 |

FOREIGN PATENT DOCUMENTS

| | | | |
|---|---|---|---|
| 1451137 | 3/1969 | Fed. Rep. of Germany | 165/110 |

*Primary Examiner*—Sheldon J. Richter

*Attorney, Agent, or Firm*—Armstrong, Nikaido, Marmelstein & Kubovcik

[57] ABSTRACT

A structure of fluid condensing and heat conducting surface of the condenser characterized in that completely recessed grooves for collecting fluid are provided on said surface integrally therewith, wherein the distance between the centers of radii of rounded corners of said groove is made less than 3 mm.

1 Claim, 4 Drawing Figures

STRUCTURE OF FLUID CONDENSING AND HEAT CONDUCTING SURFACE OF CONDENSER

BACKGROUND OF THE INVENTION:

This invention relates to a structure of fluid condensing and heat conducting surface of the plate type and tube type condensers.

Many of plate type condensers now in use have been developed from the plate type heat exchangers for exclusive use in processing of fluid-to-fluid system. A problem in the improvement of heat conducting performance of the condenser of this type is the coefficient of border filmy fluid layer which represents a degree of heat conduction on the heat conducting surface. This coefficient is expressed in terms of (heat conductivity of border filmy fluid layer/thickness of said layer), which is determined by the state of sticking of condensing fluid (vapor) to the heat conducting surface. In other words, when vapor is fed to the heat conducting surface which forms vapor flow path, small drops of fluid generates as a result of condensation of vapor in the form of filmy layer on the whole of said surface and grow larger with the continuance of condensation, finally falling down along said vertical surface by acceleration due to the weight of themselves and wind pressure caused by flowing vapor. This filmy fluid layer grows thicker as it falls downward, thereby intercepting contact of the heat conducting surface with vapor, and causes significant reduction of border layer coefficient which leads to a remarkable decrease of heat conducting efficiency. Therefore, for the improvement of heat conducting performance (total coefficient) on which vapor condenses, it is necessary to provide a device to reduce the surface area of falling filmy fluid layer as far as possible and prevent said layer from growing thicker.

Figure 1:
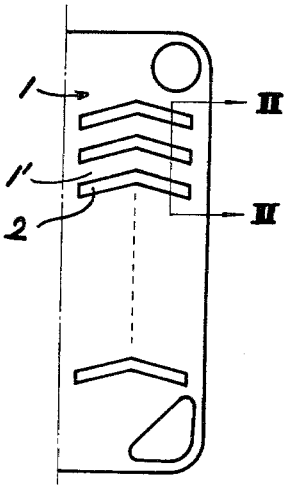
FIG. 1 is a front view of the main part of heat conducting surface for which the application of this invention is intended.
Figure 2:
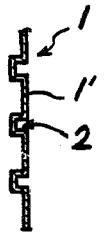
FIG. 2 is a sectional view taken along the line II—II in FIG. 1.

DESCRIPTION OF PREFERRED EMBODIMENT OF THE INVENTION:

As shown in FIGS. 1 and 2, fluid collecting grooves (2) are provided in a plurality of rows, each of which extends slantwise in two directions on the heat conducting surface (1) on the side of fluid evaporating path, for collecting the fluid which generates and flows from the condensation-conduction part (1') lying above the groove before the filmy fluid layer grows thicker, and for flowing slantwise the collected water so as to adapt said collected water to fall vertically from both ends thereof. In this way, the downwardly flowing filmy fluid layer is reduced in area to cover and prevented from growing thicker, which serves for maintenance of high level of border filmy fluid layer coefficient on the whole of heat conducting surface.

An appropriate value for the radius (R) of corner roundness of the fluid collecting groove (2) on said heat conducting surface as well as that for the center distance (L) between said rounded corners are varied according to the surface tension of condensing vapor.

An object of this invention is to provide a structure of fluid condensing and heat conducting surface on the side of vapor flow path for exhibiting the highest performance of heat conduction upon working fluid by means of finding correctly the relationship as described above.

A structure of fluid condensing and heat conducting surface for which the application of this invention is intended is provided with fluid collecting grooves (2) integrally with the heat conducting surface thereof as shown in FIGS. 1 and 2.

According to this invention, the radius (R) of corner roundness and the center distance (L) between rounded corners of said fluid collecting groove (2) are fixed at a lower dimension than 3 mm. Thus, levelling up of fluid collecting and discharging efficiency as well as a fluid condensing and heat conducting structure with excellent performance can be attained.

Figure 3:
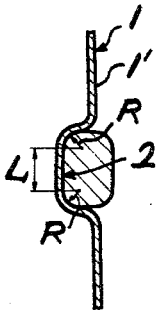
FIGS. 3 and 4 are enlarged sectional views of the main part of fluid collecting grooves shown in FIG. 2, wherein the states of fluid collection in the fluid collecting grooves when water is processed are illustrated with respect to two cases that the distances between the centers of rounded corners of the grooves are less than 3 mm and more than 3 mm, respectively.
Figure 4:
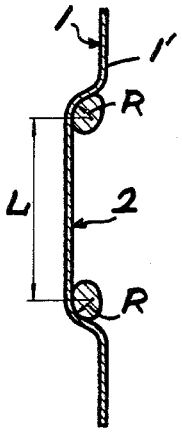

FIGS. 3 and 4 illustrate the states in which condensed fluid, for example, when vapor to be condensed, i.e. working fluid is water, is collected into the fluid collecting groove (2) as to the cases that the center distance (L) between rounded corners of the groove are less than and more than 3 mm, respectively; wherein, as shown in FIG. 3, when L is less than 3 mm, two groups of condensed fluid collecting at the upper and lower corners of the groove (2) join together, covering the whole of groove bottom, in a large quantity whereas, as shown in FIG. 4, when said center distance (L) is more than 3 mm, only a small quantity of condensed fluid is collected since each group of condensed fluid is attracted to corresponding corner by strong surface tension of itself.

The radius (R) of corner roundness of the groove (2) is in close relation with the center distance (L) between rounded corners, and it has been found by experiment that, for instance, in the case of water, a dimension of the radius (R) less than 3 mm is appropriate.

This structure is also applicable to working fluids such as ammonia, furan, etc. by selecting appropriate dimensions of the radius (R) of corner roundness and the center distance (L) between rounded corners of the groove (2) optionally but within the limited value of 3 mm. Although this invention has been described exclusively on the plate type condenser as above, it is a matter of course that this invention is sufficiently applicable to the tube type and coil type condensers, too, in expectation of the same effect as in the plate type condenser.

As described above, this invention can serve for great improvement of heat conducting performance because fluid collecting grooves are provided integrally with the heat conducting surface and the center distance between rounded corners of the groove is made less than 3 mm, thus enhancing fluid collecting and discharging efficiency.

What is claimed is:

1. A structure of a fluid condensing and heat conducting surface of a condenser plate characterized in that completely recessed grooves for collecting fluid are provided on said surface integrally therewith, said grooves each having two rounded corners of a predetermined radius with the centers of said radii being spaced from each other, and positioned on the same side of said plate, wherein the distance between the centers of radii of rounded corners of said groove is made less than 3 mm.

* * * * *